US007993567B2

(12) United States Patent
Scott-Carnell et al.

(10) Patent No.: US 7,993,567 B2
(45) Date of Patent: Aug. 9, 2011

(54) METHOD AND SYSTEM FOR ALIGNING FIBERS DURING ELECTROSPINNING

(75) Inventors: Lisa A. Scott-Carnell, Norfolk, VA (US); Ralph M Stephens, Yorktown, VA (US); Nancy M. Holloway, White Marsh, VA (US); Caroline Rhim, Durham, NC (US); Laura Niklason, Greenwich, CT (US); Robert L. Clark, Durham, NC (US); Emilie J. Siochi, Newport News, VA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 487 days.

(21) Appl. No.: 12/131,420

(22) Filed: Jun. 2, 2008

(65) Prior Publication Data

US 2009/0108503 A1 Apr. 30, 2009

Related U.S. Application Data

(60) Provisional application No. 60/936,015, filed on Jun. 1, 2007, provisional application No. 60/975,540, filed on Sep. 27, 2007.

(51) Int. Cl.
*B29C 35/00* (2006.01)

(52) U.S. Cl. ..... 264/484; 264/465

(58) Field of Classification Search ..... 425/174.8 E
See application file for complete search history.

(56) References Cited

U.S. PATENT DOCUMENTS

| | | | | |
|---|---|---|---|---|
| 4,689,186 | A * | 8/1987 | Bornat | 264/6 |
| 5,024,789 | A | 6/1991 | Berry | |
| 6,616,435 | B2 | 9/2003 | Lee et al. | |
| 2003/0146757 | A1 | 8/2003 | Aguero et al. | |
| 2004/0053553 | A1 * | 3/2004 | Dubson et al. | 442/340 |
| 2004/0054406 | A1 * | 3/2004 | Dubson et al. | 623/1.39 |
| 2004/0061253 | A1 * | 4/2004 | Kleinmeyer et al. | 264/210.8 |
| 2005/0233021 | A1 * | 10/2005 | Chun et al. | 425/174.8 E |
| 2007/0042069 | A1 * | 2/2007 | Armantrout et al. | 425/174.8 R |

(Continued)

FOREIGN PATENT DOCUMENTS

WO WO 2006/018838 A2 2/2006

OTHER PUBLICATIONS

Wu et al. Control of electrospun mat width through the use of parallel auxillary electrodes.Polymer, 2007, vol. 48, pp. 5653-5661, especially Figs. 1, 10: p. 5654, col. 1, para 3 to p. 5654, col. 2, p. 5660, col. 2, para 2.

(Continued)

*Primary Examiner* — Joseph Del Sole
*Assistant Examiner* — Kimberly A Stewart
(74) *Attorney, Agent, or Firm* — Andrea Z. Warmbier; Robin W. Edwards

(57) ABSTRACT

A method and system are provided for aligning fibers in an electrospinning process. A jet of a fiberizable material is directed towards an uncharged collector from a dispensing location that is spaced apart from the collector. While the fiberizable material is directed towards the collector, an elliptical electric field is generated via the electrically charged dispenser and an oppositely-charged control location. The field spans between the dispensing location and the control location that is within line-of-sight of the dispensing location, and impinges upon at least a portion of the collector. Various combinations of numbers and geometries of dispensers, collectors, and electrodes can be used.

44 Claims, 4 Drawing Sheets

U.S. PATENT DOCUMENTS

| | | | | |
|---|---|---|---|---|
| 2008/0110342 | A1* | 5/2008 | Ensor et al. | 96/54 |
| 2009/0152773 | A1* | 6/2009 | Barinov et al. | 264/465 |
| 2010/0222771 | A1* | 9/2010 | Mitchell et al. | 264/465 |

OTHER PUBLICATIONS

B. Sundaray, et al., Electrospinning of continuous aligned polymer fibers, Applied Physics Letters, Feb. 16, 2004, pp. 1222-1224, vol. 84, No. 7, American Institute of Physics.

A. Theron, et al., Electrostatic field-assisted alignment of electrospun nanofibers, Nanotechnology. 2001, pp. 384-390, vol. 12, Institute of Physics Publishing, Ltd.

J.M. Deitzel, et al., Controlled deposition of electrospun poly(ethylene oxide) fibers, Polymer, 2001, pp. 8163-8170, vol. 42, Elsevier Science Ltd.

* cited by examiner

METHOD AND SYSTEM FOR ALIGNING FIBERS DURING ELECTROSPINNING

Pursuant to 35 U.S.C. §119, the benefit of priority from provisional applications 60/936,015 and 60/975,540, with filing dates of Jun. 1, 2007 and Sep. 27, 2007 respectively, is claimed for this non-provisional application.

ORIGIN OF THE INVENTION

This invention was made in part by employees of the United States Government and may be manufactured and used by or for the Government of the United States of America for governmental purposes without the payment of any royalties thereon or therefor.

BACKGROUND OF THE INVENTION

1. Field of the Invention

This invention relates to electrospinning. More specifically, the invention is a method and system for aligning fibers for the controlled placement thereof during an electrospinning process using an elliptical electric field to guide fiber deposition.

2. Description of the Related Art

Electrospinning is a polymer manufacturing process that has been revived over the past decade in order to produce micro and nano fibers as well as resulting fiber groups (or mats as they are known) with properties that can be tailored to specific applications by controlling fiber diameter and mat porosity. The individual fibers are formed by applying a high electrostatic field to a polymer solution that carries a charge sufficient to attract the solution to a grounded source. Parameters that determine fiber formation include solution viscosity, polymer/solvent interaction, surface tension, applied voltage, distance between the spinneret and collector, and the conductivity of the solution.

Typically, only non-woven mats can be produced during this process due to splaying of the fibers and jet instability of the polymer expelled from the spinneret. These non-woven mats can be used as scaffolds for tissue engineering, wound dressings, clothing, filters, and membranes. While non-woven mats have proven to be useful for a variety of applications, controlling fiber alignment in the mat is a desirable characteristic to expand the applications of electrospun materials. Particularly for the case of tissue engineering scaffolds, the control of fiber distribution, fiber alignment, and porosity of the scaffold are crucial for the success of any scaffold. Current manufacturing techniques are limited by erratic polymer whipping that often produces dense nanofiber mats, which cannot support cell infiltration or cell alignment.

SUMMARY OF THE INVENTION

Accordingly, it is an object of the present invention to provide a method and system for aligning fibers produced during an electrospinning process.

Another object of the present invention is to provide a method and system for controlling fiber alignment and/or fiber placement during fiber deposition on a collector by means of electrospinning.

Other objects and advantages of the present invention will become more obvious hereinafter in the specification and drawings.

In accordance with the present invention, a method and system are provided for aligning fibers in an electrospinning process. A jet of a fiberizable material is directed towards an uncharged collector from a dispensing location (e.g., an electrically charged spinneret) that is spaced apart from the collector. While the fiberizable material is directed towards the collector, an elliptical electric field is generated via the electrically charged dispenser and an oppositely-charged control location. The term "elliptical" as used herein includes elliptical and all dipole field-like shapes, including both symmetric and unsymmetric, and including both spherical and ovoid. The field is generated such that it (i) spans between the dispensing location and the control location comprising an oppositely-charged electrode that is within line-of-sight of the dispensing location, and (ii) impinges upon at least a portion of the collector.

DETAILED DESCRIPTION OF THE INVENTION

Figure 1:
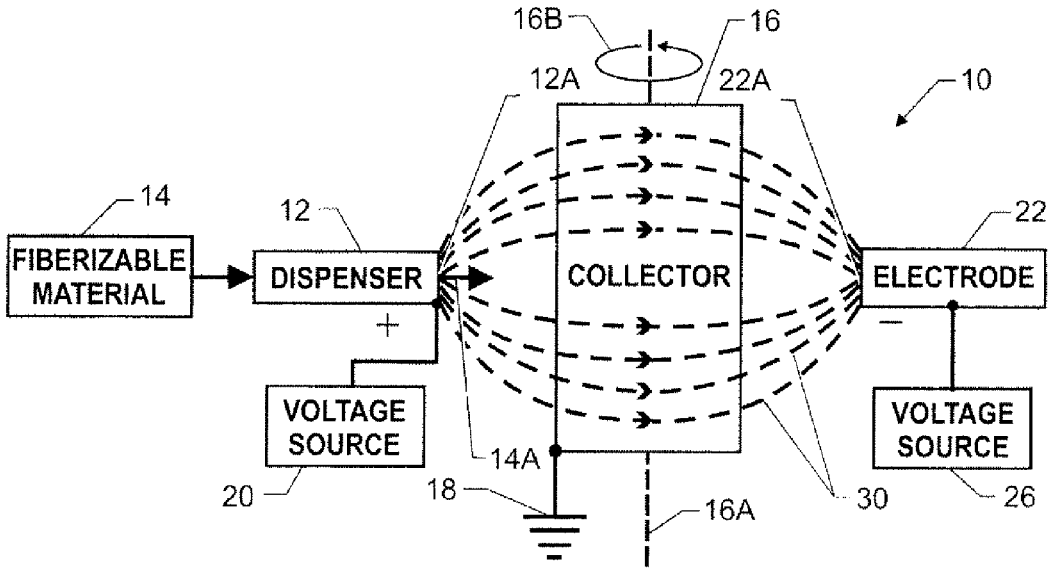
FIG. 1 is a schematic view of a system for producing aligned electrospun fibers in accordance with an embodiment of the present invention.

Referring now to the drawings and more particularly to FIG. 1, an electrospinning system for fabricating a mat of aligned fibers in accordance with the present invention is shown and is referenced generally by numeral 10. For simplicity of discussion, system 10 will be described for its use in producing a single-ply mat with aligned single fibers or fiber bundles that are substantially parallel to one another. However, as will be explained further below, the present invention can also be used to produce a multiple-ply mat where fiber orientation between adjacent plies is different to thereby create a porous multi-ply mat. Such multi-ply porous mats could be used in a variety of industries/applications without departing from the scope of the present invention as would be understood by one of ordinary skill in the art.

In general, system 10 includes a dispenser 12 capable of discharging a fiberizable material 14 therefrom in jet stream form (as indicated by arrow 14A) that will be deposited as a single fiber or fiber bundles (not shown) on a collector 16. Dispenser 12 is typically a spinneret through which fiberizable material 14 is pumped as is well known in the art of electrospinning. The type and construction of dispenser 12 will dictate whether a single fiber or fiber bundles are deposited on collector 16. Fiberizable material 14 is any viscous solution that will form a fiber after being discharged from dispenser 12 and deposited on collector 16. Typically, material 14 includes a polymeric material and can include disparate material fillers mixed therein to give the resulting fiber desired properties. Examples of suitable fillers are ceramic particles, metal particles, nanotubes and nanoparticles. Suitable collectors 16 include a static plate, a wire mesh, a moving-conveyor-type collector, or a rotating drum/mandrel fabricated in a variety of shapes and configurations, the choice of which is not a limitation of the present invention. For the illustrated example, collector 16 will be rotated about its longitudinal axis 16A as indicated by rotational arrow 16B. In the present invention, collector 16 is maintained in an electrical uncharged state (e.g., floating or coupled to an electric ground potential 18 as illustrated). The fiber deposition surface of collector 16 can be electrically conductive (e.g., copper or aluminum), semi-conductive, or non-conductive without departing from the scope of the present invention.

Dispenser 12 is positioned such that its dispensing aperture 12A faces collector 16 a short distance therefrom as would be understood in the electrospinning art. For example, if dispenser 12 is a spinneret, aperture 12A represents the exit opening of the spinneret. In the present invention, the portion of dispenser 12 defining aperture 12A should be electrically conductive. A voltage source 20 is coupled to dispenser 12 such that an electric charge is generated at the portion of dispenser 12 defining aperture 12A.

Positioned near collector 16 and within the line-of-sight of aperture 12A is an electrode 22. More specifically, a tip 22A of electrode 22 is positioned within line-of-sight of aperture 12A as is readily seen in FIG. 2 where dashed line 24 indicates the unobstructed line-of-sight communication between aperture 12A and electrode tip 22A. A voltage source 26 is coupled to electrode 22 such that an electric charge is generated at electrode tip 22A. The charge is opposite in polarity to that of the charge on the portion of dispenser 12 defining aperture 12A. That is, if the charge is positive at aperture 12A (as indicated), the charge should be negative at electrode tip 22A (as illustrated), Similarly, if the charge is negative at aperture 12A, the charge should be positive at electrode tip 22A. The magnitude of the voltages applied to dispenser 12 and electrode 22 can be the same or different without departing from the scope of the present invention.

The opposite-polarity charges at dispenser aperture 12A and electrode tip 22A cause an electric field of controllable geometry and magnitude to be generated therebetween as represented by dashed lines 30. In general, if the geometric shape of dispenser 12 at aperture 12A and electrode tip 22A are substantially the same, electric field 30 will be spherical and uniform. Typically, aperture 12A and electrode tip 22A will be circular, and they can be the same or different in terms of their size. Since aperture 12A and electrode tip 22A are in line-of-sight of one another, some portion of electric field 30 will impinge upon the surface of collector 16. This will be true whether electrode tip 22A is positioned centrally with respect to collector 16 (as illustrated), or at any position along collector 16. The magnitude of the electric field is determined by the voltages 20 and 26.

In operation, dispenser 12 and electrode 22 are positioned with respect to collector 16 as described above. Opposite-polarity voltages are applied to dispenser 12 and electrode 22 in order to establish electric field 30 with at least a portion of collector 16 being disposed in electric field 30. Fiberizable material 14 is pumped from dispenser 12 such that a jet stream 14A thereof is subject to electric field 30. A pulsed electric field, generated for example by pulsing the voltages applied to dispenser 12 and electrode 22, may also be used.

Figure 2:
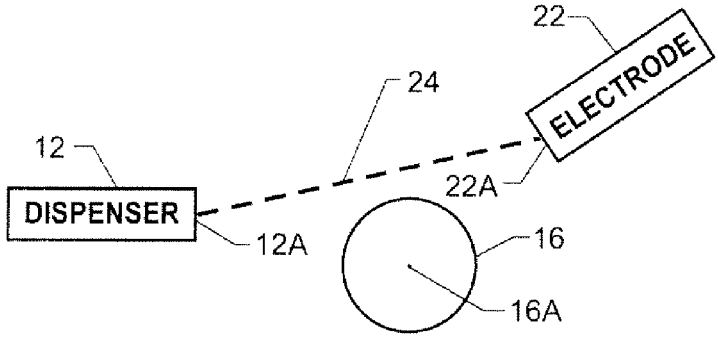
FIG. 2 is a view of a portion of the system in FIG. 1 illustrating position for the fiberizable material dispenser and the electrode in accordance with an embodiment of the present invention.
Figure 3:
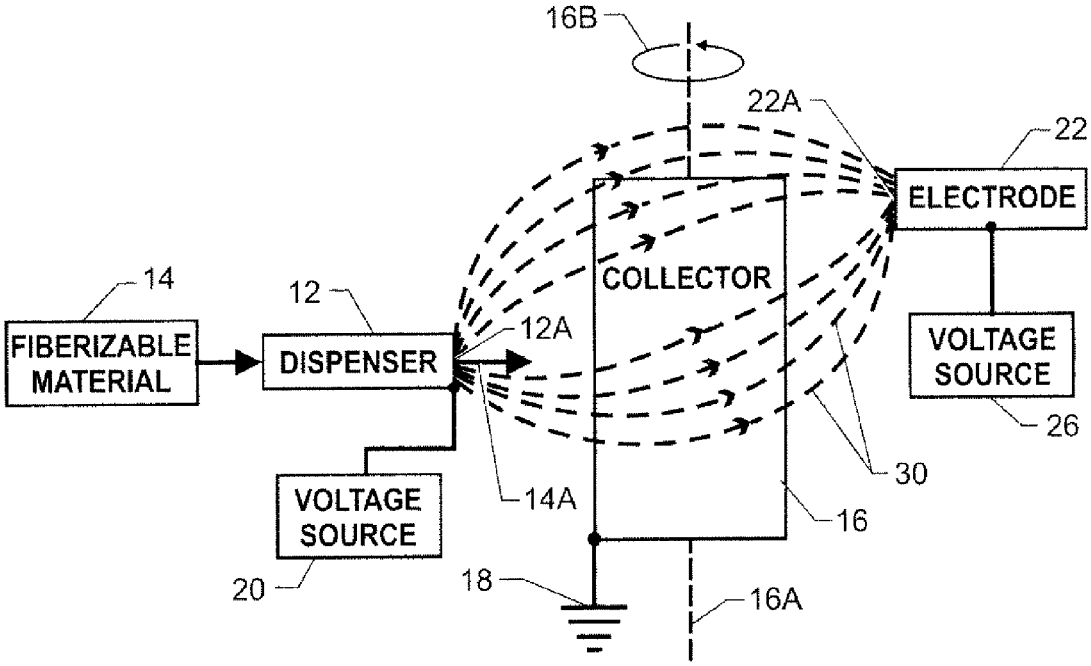
FIG. 3 is a schematic view of a system for producing aligned electrospun fibers in accordance with another embodiment of the present invention.

By judicious placement of dispenser 12 and electrode 22, the orientation of the field lines of electric field 30 can be predetermined for a particular application. For example, FIG. 3 illustrates an electrode 22 placement that will cause the electric field lines of field 30 and, therefore fiber orientation, to be angled with respect to longitudinal axis 16A of collector 16. While FIG. 2 and FIG. 3 illustrate two different orientations, other orientations of the dispenser 12, collector 16, and electrode 22 can be used so long as an elliptical electric field is generated.

The advantages of the present invention are numerous. The electrospinning process has been improved to provide for the fabrication of aligned-fiber mats. The generation of an elliptical electric field and placement of an uncharged collector therein will align fibers as they are deposited on the collector. A broad range of fiber diameters can be produced by modifying the viscosity of the fiberizable material 14. In tests of the present invention, polymer fibers in the order of 10 μm in diameter were deposited with uniform spacing ranging between 25-30 μm. In other tests, nano-sized polymer fibers on the order of 500 nm to 1 μm in diameter were deposited with uniform spacing ranging between 7-10 μm. Thus, the present invention will provide for predictability in fiber alignment and spacing so that fiber mats can be designed for use in a variety of industries/applications.

The present invention is further illustrated by the following examples.

EXAMPLE 1

A 10 wt % polymer solution was prepared by dissolving colorless polyimide CP2 [(2,2-bis(3-aminophenyl) hexafluoropropane+1,3-bis(3-aminophenoxy)benzene)] ([η]=1.2 dL/g) in chloroform. CP2 was electrospun using a 10 mL syringe fitted with an 18 gauge blunt end needle. A syringe pump was used to deliver a constant flow rate of 2 ml/hr. A rotating collector (approximately 2400 rpm) was positioned 5-20 cm from the tip of the needle. The collector was grounded and a Kapton® film was placed around the barrel of the collector to create an insulative surface. An alligator clip was used to attach a high voltage power supply to the needle to distribute a positive voltage to the polymer solution. An electrode (stainless steel needle) was positioned at an angle 90° directly above the top of the rotating collector using a plexi-glass mounting bracket. An alligator clip was used to attach the high voltage power supply to the electrode to generate a negative voltage equal and opposite to the positive voltage. Mat images were obtained using a Kodak® 14N camera fitted with a 105 mm Nikon® macro lens. The equipotential lines and field strengths were modeled using Matlab® software.

Several experimental trials were performed in order to determine the effect of the electric field on fiber orientation and distribution. For each trial, CP2 was collected for a period of approximately one second at four different distances; 5 cm, 10 cm, 15 cm and 20 cm with applied voltages of +/−5 kV, +/−10 kV, +/−15 kV and +/−20 kV at each distance. This was accomplished by pulsing the power supplies on and off in an attempt to create a single rotational uptake of fibers. This technique allowed the examination of fiber orientation and overall mat width; however, exact fiber distribution was not determined due to the inability to collect precisely one uptake of the fibers, hence, only a general assessment of fiber distribution could be ascertained from the data. The fiber density decreased with increasing distance and decreasing field strength. The relationship appeared to be fairly linear with the total fiber mat widths being approximately 0.5 cm, 0.6 cm, 0.8 cm and 1.0 cm for collection distances of 5 cm, 10 cm, 15 cm and 20 cm, respectively, at +/−10 kV. The fiber diameter and morphology were not significantly affected as the field strength varied.

EXAMPLE 2

CP2 ([η]=1.2 dL/g) was dissolved in chloroform (10 wt %) at room temperature and allowed to stir for a minimum of 2 hours prior to use. Polyglycolic acid (PGA) was dissolved in hexafluoroisopropanol (HFIP) under low heat and allowed to stir overnight until all particles were dissolved.

CP2 was electrospun using a 10 mL syringe and an 18 gauge blunt end needle. A constant flow rate of 2 ml/hr was obtained using a syringe pump. A rotating collector (approximately 2400 rpm) was positioned 13-17 cm from the tip of the needle. The collector was grounded and Kapton® polymer film was placed around the barrel of the collector to create an insulative surface. An alligator clip was used to attach the high voltage power supply to the needle to distribute a positive voltage of 10 kV to the polymer solution. PGA was electrospun using a 10 mL syringe and a 22 gauge blunt end needle at a constant flow rate of 1.5 ml/hr. The rotating collector was positioned 10-17 cm from the tip of the needle and a positive voltage of 15 kV was applied to the polymer solution. For each polymer, an auxiliary electrode (stainless steel needle) was positioned at an angle 90° directly above the top of the rotating collector using a plexi-glass mounting bracket. An alligator clip was used to attach the high voltage power supply to the auxiliary electrode to generate a negative voltage equal and opposite to the positive voltage.

Fibers and mats were coated with 4-8 nm of Au/Pd using a sputter coater. Images were obtained using a scanning electron microscope and a high resolution scanning electron microscope. Image processing and analysis of fiber diameter and degree of alignment were performed.

High speed videos were captured at 2000 frames/sec and data was processed and post-processed. High speed video imaging was used to capture the fiber from jet initiation through collection on the rotating mandrel. Jet exit images illustrated the stability of the fiber as it overcame surface tension and was drawn into the electric field. The fiber continued along the field line path and was pulled straight to the rotating mandrel. Jet whipping and bending instability that are typical characteristics of electrospinning were not observed. The fiber continued to follow the straight electric field path after a period of 5 minutes. In order to verify the influence of the control electrode on controlling fiber placement and alignment, the location of the control electrode was repositioned to a location offset from the spinneret. The fiber was directed to the rotating mandrel only at the location of the control electrode.

In order to determine the effect of the electric field on the fiber alignment and distribution over time, each polymer was collected for a period of 30 seconds. Fibers that were electrospun from CP2 were on the order of 10 μm in diameter. The spacing between fibers was fairly uniform and ranged from approximately 25-30 μm. Nanofibers were observed for the PGA polymer. The PGA fibers were approximately 500 nm-1 μm in diameter with spacing between fibers in the range of 7-10 μm.

Figure 4A:
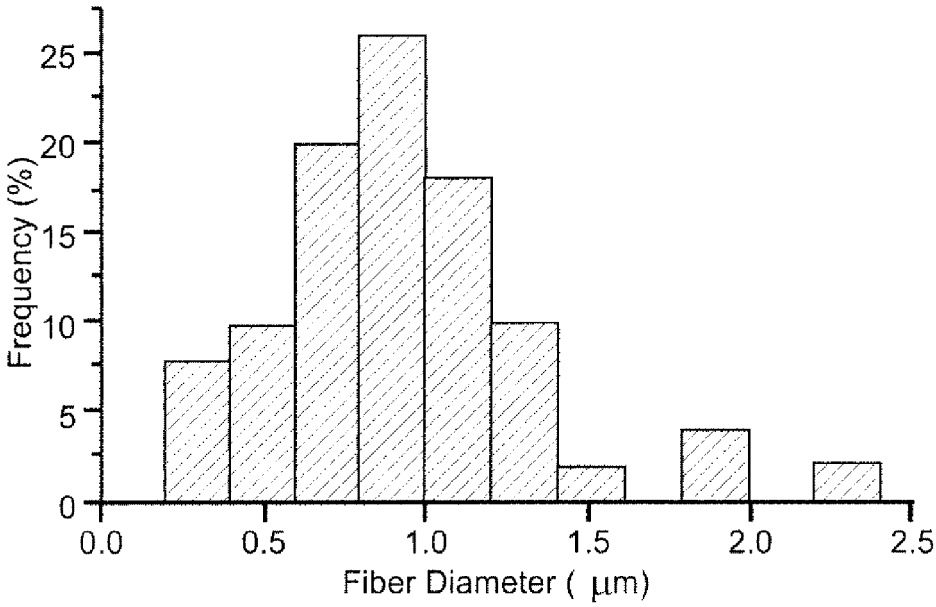
FIGS. 4A and 4B illustrate example fiber distributions in accordance with an embodiment of the present invention.
Figure 4B:
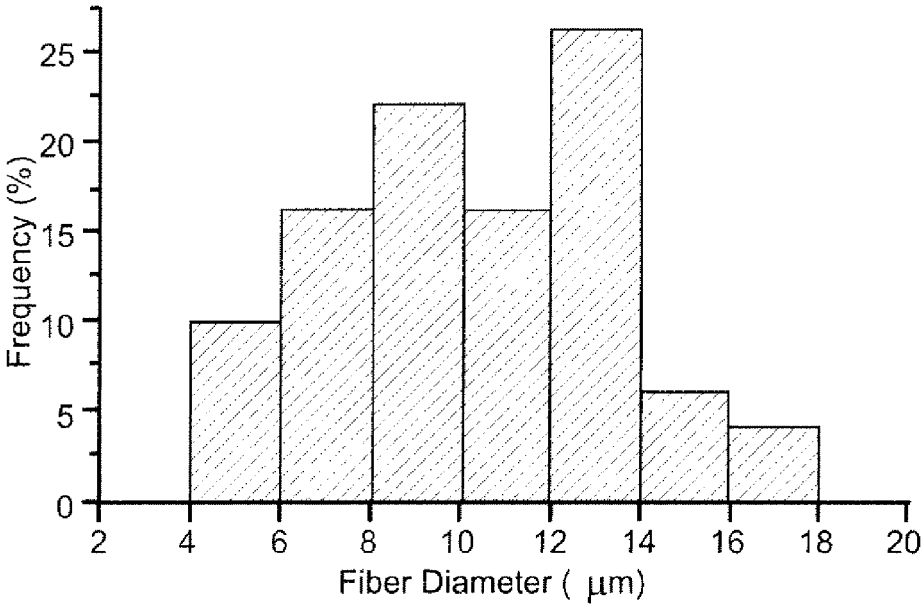

Pseudo-woven mats were generated by electrospinning multiple layers in a 0°/90° lay-up. This was achieved by electrospinning the first layer onto a Kapton® film attached to the collector, removing the polymer film, rotating it 90°, reattaching it to the collector and electrospinning the second layer on top of the first, resulting in the second layer lying 90° relative to the first layer. Fibers were collected for one minute in each direction. A high degree of alignment was observed in this configuration. In order to assess the quality of a thicker pseudo-woven mat, the lay-up procedure was repeated 15 times in each direction (0°/90°) for a period of 30-60 seconds for each orientation, generating a total of 30 layers. The average fiber diameter for the CP2 pseudo-woven mat was 9.9±3.3 μm and the PGA mat had an average fiber diameter of 0.91±0.4 μm. The distribution in fiber diameter is illustrated in FIGS. 4A (PGA (average 0.91±0.4 μm)) and 4B (CP2 (average 9.9±3.3 μm)). PGA exhibited a much narrower Gaussian fiber diameter distribution while the CP2 polymer had a much broader range of fiber diameters. The degree of alignment was determined for each material by measuring the angle of the long axis of the fiber relative to the plane of the collector at deposition for each 0°/90° orientation. The data obtained for both polymers indicated excellent alignment with CP2 having an average degree of alignment of 89.7°±1.7° and PGA with 89.5°±4.8°.

EXAMPLE 3

Figure 5:
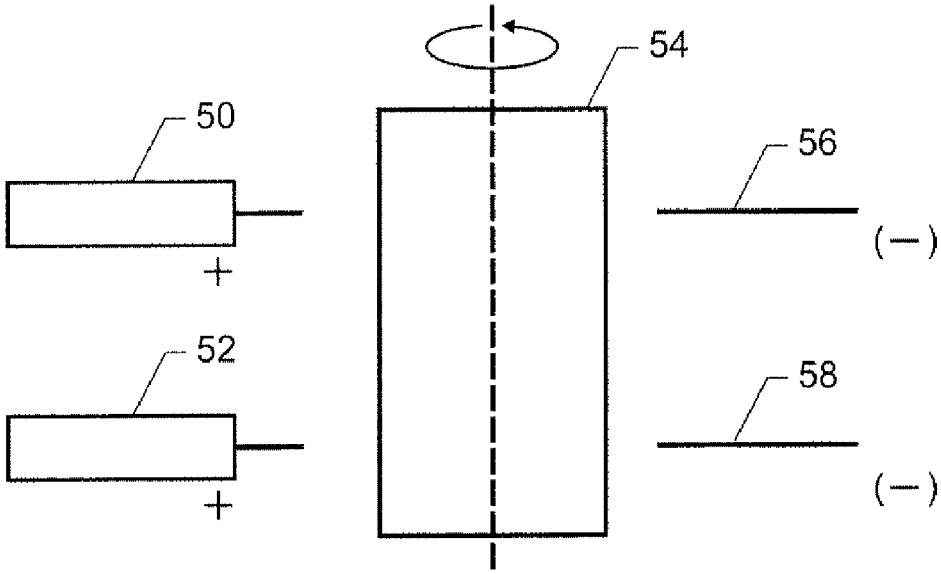
FIG. 5 illustrates an example set-up for dual dispensing and control locations in accordance with an embodiment of the present invention.

CP2 was electrospun using two 10 mL syringes and 18 gauge blunt end needles 50 and 52 using the set-up generally illustrated in FIG. 5. A constant flow rate of 2 ml/hr at each syringe was obtained using a dual syringe pump. A rotating collector 54 (approximately 2400 rpm) was positioned 13-17 cm from the tip of the needles. The collector was grounded and Mylar® film was placed around the barrel of the collector to create an insulative surface. Alligator clips were used to attach the high voltage power supply to the needles to distribute a positive voltage of 10 kV to the polymer solutions. Alligator clips were used to attach the high voltage power supply to the control electrodes 56 and 58 to generate a negative voltage equal and opposite to the positive voltage. Two distinct fiber mats were generated using the dual syringe and dual control electrodes. The fibers produced were highly aligned for each syringe/control electrode location.

The present invention is further discussed in Lisa A. Carnell et al., Aligned Mats from Electrospun Single Fibers, Macromolecules (accepted 2008), the contents of which are incorporated by reference herein in their entirety.

Although the invention has been described relative to specific embodiments thereof, there are numerous variations and modifications that will be readily apparent to those skilled in the art in light of the above teachings. For example, the present invention can be extended to the fabrication of multiple-ply fiber mats with fiber orientation between the plies being pre-determined. One method of accomplishing this is to attach a polymer film to the collector and deposit aligned fibers thereon as described above. The resulting polymer film/fiber mat can be removed from the collector and then re-positioned on the collector so that the next ply of aligned fibers are deposited on the first ply at a pre-determined orientation with respect thereto. This process can be repeated as frequently as desired until the desired mat thickness is achieved. Since fiber spacing and alignment are readily controlled by the present invention, the porosity of the final mat structure can also be controlled.

The present invention could also incorporate mobile versions (e.g., via mobile or motorized mountings in one or more directions such as rotation and/or translation) of dispenser 12 and/or electrode 22 and/or collector 16 to permit the movement thereof before or during fiber deposition. Still further, the present invention can be extended to use multiple dispensers 12 and/or electrodes 22 and/or collectors 16, where one or more of each can be mobile as previously described. The multiple dispensers 12 and/or electrodes 22 may be electrically connected or separate and may be of the same or different physical form, material and charge magnitude. The multiple dispensers 12 may direct the same or different fiberizable materials. Additionally, one or more of the dispenser 12 and electrode 22 combinations may produce pulsed electric fields. Further, the numbers of dispensers 12, collectors 16, and electrodes 22 are not required to be equal, and a system can be configured to have each element (dispenser 12, collector 16 and electrode 22) communicating with one or more other elements (dispenser 12, collector 16 and electrode 22). Numerous configurations of each of dispensers 12, collectors 16 and electrodes 22, can be utilized (such as stacked, rotating, etc.), with such configuration(s) not being limitation of the present invention as long as the appropriate elliptical electric field is generated.

Further, the collector could comprise one or more fiber deposition surfaces located thereon. In an alternate embodiment, the collector can be attached (via clamping, gluing, taping or other suitable means) to the electrode, in which case it would then carry the same charge as the electrode.

It is therefore to be understood that, within the scope of the appended claims, the invention may be practiced other than as specifically described.

The invention claimed is:

1. A method of aligning fibers in an electrospinning process, comprising the steps of:

providing one or more uncharged collectors and one or more dispensing locations:

directing one or more jets of one or more fiberizable materials towards said one or more collectors from said one or more dispensing locations that are spaced apart from said one or more collectors, wherein said one or more dispensing locations comprise one or more dispensing apertures;

providing one or more control locations, wherein said one or more control locations comprise one or more control tips; and generating, during said step of directing, one or more electric fields via said one or more dispensing locations and said one or more corresponding control locations that (i) span between said corresponding one or more dispensing apertures and said corresponding one or more control tips that are within an unobstructed line-of-sight of said corresponding dispensing apertures, and (ii) impinge upon at least a portion of said corresponding one or more collectors.

2. A method according to claim 1 further comprising the step of coupling each said collector to an electric ground potential.

3. A method according to claim 1 wherein each said collector is electrically floating.

4. A method according to claim 1 wherein each of said dispensing apertures and each of said control tips comprise substantially the same geometric shape.

5. A method according to claim 1 wherein each of said dispensing apertures and each of said control tips are defined by a substantially circular shape.

6. A method according to claim 1 wherein at least one said fiberizable material comprises a polymeric material.

7. A method according to claim 1 wherein at least one said fiberizable material comprises material fillers.

8. A method according to claim 1 wherein said step of directing comprises the step of positioning one or more outputs corresponding to one or more spinnerets at each said dispensing location.

9. A method according to claim 1 wherein said step of generating comprises the step of positioning one or more electrodes at each said control location.

10. A method according to claim 1 further comprising the step of moving at least one of said one or more collectors during said steps of directing and generating.

11. A method according to claim 1 further comprising the step of moving at least one of said one or more dispensing locations during said steps of directing and generating.

12. A method according to claim 1 further comprising the step of moving at least one of said one or more control locations during said steps of directing and generating.

13. A method according to claim 1 wherein said fibers are selected from one or more of the group consisting of single fibers and fiber bundles.

14. A method according to claim 1 wherein the surface material of each said collector is selected from the group consisting of conductive, nonconductive and semi-conductive.

15. A method according to claim 1 wherein said fibers can be removed from said one or more collectors.

16. A method according to claim 1 wherein at least one of said one or more electric fields is pulsed.

17. A method according to claim 1 wherein each said collector comprises one or more fiber deposition surfaces.

18. A method of aligning fibers in an electrospinning process, comprising the steps of:

providing an uncharged collector and an electrically-conductive spinneret;

positioning said spinneret in a spaced-apart relationship with the collector, the spinneret having an output facing the collector;

providing an electrode having a tip;

positioning the tip of the electrode at a control location that is spaced apart from the collector with the collector being substantially disposed between the spinneret's output and the electrode's tip while the spinneret's output and the electrode's tip remain in line-of-sight of one another, the spinneret's output and the electrode's tip having substantially the same geometric shape;

applying voltages of opposing polarity to the spinneret's output and the electrode's tip; and pumping a fiberizable material through the spinneret during said step of applying.

19. A method according to claim 18 further comprising the step of coupling the collector to an electric ground potential.

20. A method according to claim 18 wherein said collector is electrically floating.

21. A method according to claim 18 wherein said geometric shape is circular.

22. A method according to claim 18 wherein said fiberizable material comprises a polymeric material.

23. A method cording to claim 18 wherein said fiberizable material comprises material fillers.

24. A method according to claim 18 wherein said voltages are equal to one another.

25. A method according to claim 18 further comprising the step of moving the collector during said steps of applying and pumping.

26. A method according to claim 18 further comprising the step of moving the spinneret during said steps of applying and pumping.

27. A method according to claim 18 further comprising the step of moving the electrode during said steps of applying and pumping.

28. A method according to claim 18 wherein said fibers can be removed from said collector.

29. A method according to claim 18 wherein said electric field is pulsed.

30. A method according to claim 18 wherein each said collector comprises one or more fiber deposition surfaces.

31. A method of aligning fibers in an electrospinning process, comprising the steps of:

providing one or more collectors, one or more dispensing locations, and one or more control locations;

directing one or more jets of one or more fiberizable materials towards said one or more collectors from said one or more dispensing locations that are spaced apart from said one or more corresponding collectors; and generating, during said step of directing, one or more electric fields via said one or more dispensing locations and one or more corresponding control locations that (i) span between said corresponding dispensing location and said corresponding one or more control locations that are within an unobstructed line-of-sight of said corresponding dispensing location, and (ii) impinges upon at least a portion of said corresponding one or more collectors.

32. A method according to claim 31 wherein said one or more dispensing locations comprise one or more apertures and said one or more comprise one or more tips, wherein each of said apertures and each of said tips comprise substantially the same geometric shape.

33. A method according to claim 31 wherein at least one said fiberizable material comprises a polymeric material.

34. A method according to claim 31 wherein at least one said fiberizable material comprises material fillers.

35. A method according to claim 31 wherein said step of directing comprises the step of positioning one or more outputs corresponding to one or more spinnerets at each said dispensing location.

36. A method according to claim 31 wherein said step of generating comprises the step of positioning one or more electrodes at each said control location.

37. A method according to claim 31 further comprising the step of moving at least one of said one or more collectors during said steps of directing and generating.

38. A method according to claim 31 further comprising the step of moving at least one of said one or more dispensing locations during said steps of directing and generating.

39. A method according to claim 31 further comprising the step of moving at least one of said one or more control locations during said steps of directing and generating.

40. A method according to claim 31 wherein said fibers are selected from one or more of the group consisting of single fibers and fiber bundles.

41. A method according to claim 31 wherein the surface material of each said collector is selected form the group consisting of conductive, nonconductive and semi-conductive.

42. A method according to claim 31 wherein said fibers can be removed from said one or more collectors.

43. A method according to claim 31 wherein at least one of said one or more electric fields is pulsed.

44. A method according to claim 31 wherein each said collector comprises one or more fiber deposition surfaces.

* * * * *